US010477972B2

(12) United States Patent
Su

(10) Patent No.: US 10,477,972 B2
(45) Date of Patent: Nov. 19, 2019

(54) ASSEMBLING STRUCTURE OF SUPPORT DEVICE OF A CHAIR

(71) Applicant: Chih-Cheng Su, Dongguan (CN)

(72) Inventor: Chih-Cheng Su, Dongguan (CN)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 0 days.

(21) Appl. No.: 15/934,949

(22) Filed: Mar. 24, 2018

(65) Prior Publication Data

US 2019/0290008 A1 Sep. 26, 2019

(51) Int. Cl.
*A47C 7/28* (2006.01)
*A47C 7/74* (2006.01)

(52) U.S. Cl.
CPC ..... *A47C 7/282* (2013.01); *A47C 7/742* (2013.01)

(58) Field of Classification Search
CPC ..... A47C 7/282; A47C 7/742
See application file for complete search history.

(56) References Cited

U.S. PATENT DOCUMENTS 6,375,269 B1 * 4/2002 Maeda ..... A47C 7/282 297/218.2
6,688,690 B2 * 2/2004 Watson ..... A47C 7/282 297/316
6,983,997 B2 * 1/2006 Wilkerson ..... A47C 1/023 297/452.13
7,066,550 B1 * 6/2006 Su ..... A47C 7/282 297/440.22
7,425,039 B2 * 9/2008 Lin ..... A47C 31/023 297/452.56
7,837,272 B2 * 11/2010 Masunaga ..... A47C 7/282 297/218.1
8,029,066 B2 * 10/2011 Su ..... A47C 31/023 297/440.11
8,109,576 B2 * 2/2012 Lin ..... A47C 31/02 297/452.13
8,616,655 B2 * 12/2013 Jung ..... A47C 7/282 297/452.56
9,580,175 B2 * 2/2017 Velasco ..... B64D 11/06
9,713,384 B1 * 7/2017 Chen ..... A47C 7/40
9,986,845 B1 * 6/2018 Hsieh ..... F16B 2/005
10,111,535 B2 * 10/2018 Coffield ..... A47C 31/023
2004/0262975 A1 * 12/2004 Su ..... A47C 5/06 297/440.11
2005/0166317 A1 * 8/2005 Kelly ..... A47C 7/282 5/110
2008/0079307 A1 * 4/2008 Su ..... A47C 7/282 297/452.56
2014/0287188 A1 * 9/2014 Naitou ..... A47C 31/023 428/99

* cited by examiner

*Primary Examiner* — Philip F Gabler

(57) ABSTRACT

The invention includes an outer frame, fasteners, an inner frame, a supporting body and pressing strips. The outer frame has a surrounding trough. The fasteners are disposed in the surrounding trough. Each fastener has an engaging portion. The supporting body is made of a flexible material and has a loading side and a connecting side. The pressing strips are surroundingly attached on a periphery of the connecting side. An interval is kept between two adjacent pressing strips to provide flexibility. The supporting body covers the front of the inner frame. The pressing strips are fastened onto the rear of the inner frame. The inner frame with the supporting body is embedded into the surrounding trough to engage with the engaging portions of the fasteners.

8 Claims, 9 Drawing Sheets

ASSEMBLING STRUCTURE OF SUPPORT DEVICE OF A CHAIR

BACKGROUND OF THE INVENTION

1. Technical Field

The invention relates to chairs, particularly to support devices made by mesh or fabric for supporting a user's back or buttock.

2. Related Art

A support device of a chair, such as a backrest or a chair seat, is usually formed by leather or fabric covering sponge as a supporting body and mounted on a bottom. It provides comfortable support, but its breathability is bad. Thus flexible materials such as meshed fabric are used as a supporting body. Meshed fabric is assembled on a hollow frame to serve as a backrest or chair seat. Such a material can offer great breathability and comfort of sitting.

However, meshed fabric has many meshes, so it is difficult to assemble meshed fabric onto a frame. Simply adhering or sewing process may not provide completely enough support to the meshed fabric pressed by a user's weight. As a result, the meshed fabric splits easily. If a complicated mechanical structure is applied to assemble, then the yield rate is too low and the assembling is time-consuming and laborious.

Furthermore, because meshed fabric tends to be soft, it is easy to crease in a manufacture, storage or shift after it has been cut to fit the frame, especially at the corners. This will be adverse to subsequent processes and finished product quality.

SUMMARY OF THE INVENTION

An object of the invention is to provide an assembling structure of support device of a chair, which makes the manufacture easy and rapid, can provide the supporting body sufficient fastening and completely cloaks the connecting edge of the supporting body.

To accomplish the above object, assembling structure of support device of the invention includes an outer frame, fasteners, an inner frame, a supporting body and pressing strips. The outer frame has a surrounding trough. The fasteners are disposed in the surrounding trough. Each fastener has an engaging portion. The supporting body is made of a flexible material and has a loading side and a connecting side. The pressing strips are surroundingly attached on a periphery of the connecting side. An interval is kept between two adjacent pressing strips to provide flexibility. The supporting body covers the front of the inner frame. The pressing strips are fastened onto the rear of the inner frame. The inner frame with the supporting body is embedded into the surrounding trough to engage with the engaging portions of the fasteners.

In comparison with prior art, the invention has following advantages:

1. The pressing strips fix the shape of the soft supporting body in advance. It is advantageous to assembling. And corners of the supporting body can be protected by the pressing strips to prevent crease or damage.

2. The supporting body is assembled on the inner frame in advance. It is advantageous to subsequent management, storage and shift.

The fasteners make the connection between the inner frame and outer frame easier. It can be done without tools and can be automatically produced. This can raise production capacity and save labor cost. The inner frame is embedded into the surrounding trough of the outer frame, so the supporting body can be fastened by pressure, grip and engagement between the fasteners 6 and the installing holes. The supporting body is toughly fixed. The connecting side 41 of the supporting body can be totally cloaked. A better finished appearance can be obtained.

DETAILED DESCRIPTION OF THE INVENTION

Figure 1:
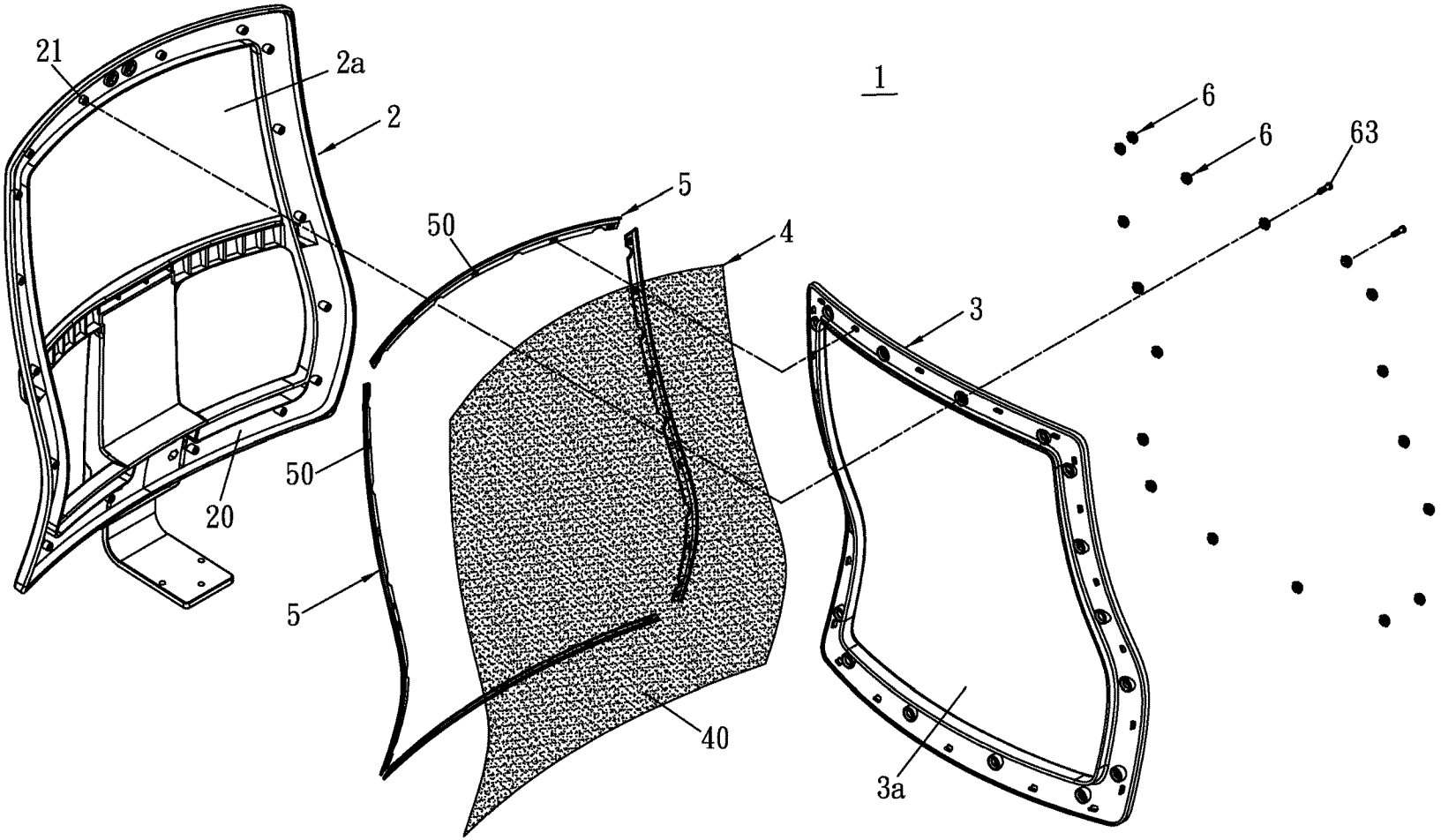
FIG. 1 is an exploded view of the invention.

The support device pointed out by the invention is a backrest or a seat connected to a chair to support a user's back or buttock. As an example, a backrest 1 shown in FIG. 1 includes an outer frame 2, an inner frame 3, a flexible supporting body 4, pressing strips 5 and fasteners 6. The outer frame 2 and the inner frame 3 have their respective hollows 2*a*, 3*a* corresponding to each other. A side of the outer frame 2 is connected to a chair, and the other side thereof is formed with a surrounding trough 20 for receiving the inner frame 3.

Figure 2:
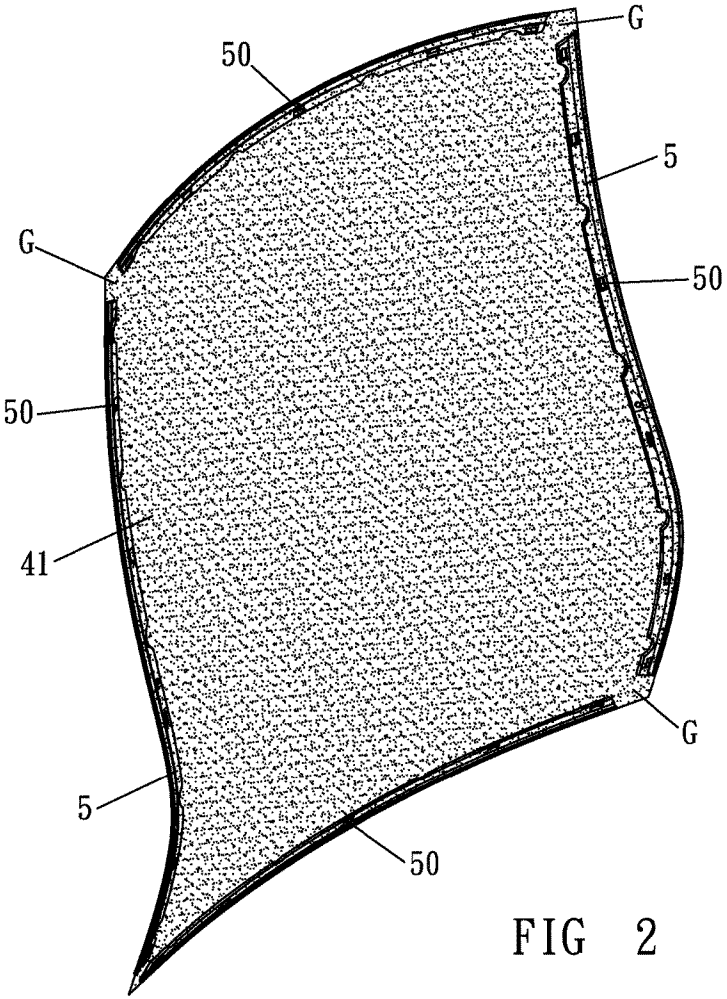
FIG. 2 is an assembled view of the pressing strips and the supporting body of the invention.

Please refer to FIG. 2. The supporting body 4 may be a sheet of soft net or fabric with great breathability. It includes a loading side 40 and a connecting side 41. The loading side 40 is used for contacting a user's back or buttock to provide support. The pressing strips 5 surround the supporting body 4 and are attached on a periphery of the connecting side 41. An interval G is kept between two adjacent pressing strips 5 to provide flexibility to the supporting body 4. Each pressing strip 5 is formed with fastening holes 50. The more intensively the fastening holes 50 are arranged, the firmer the assembling strength is.

Figure 3:
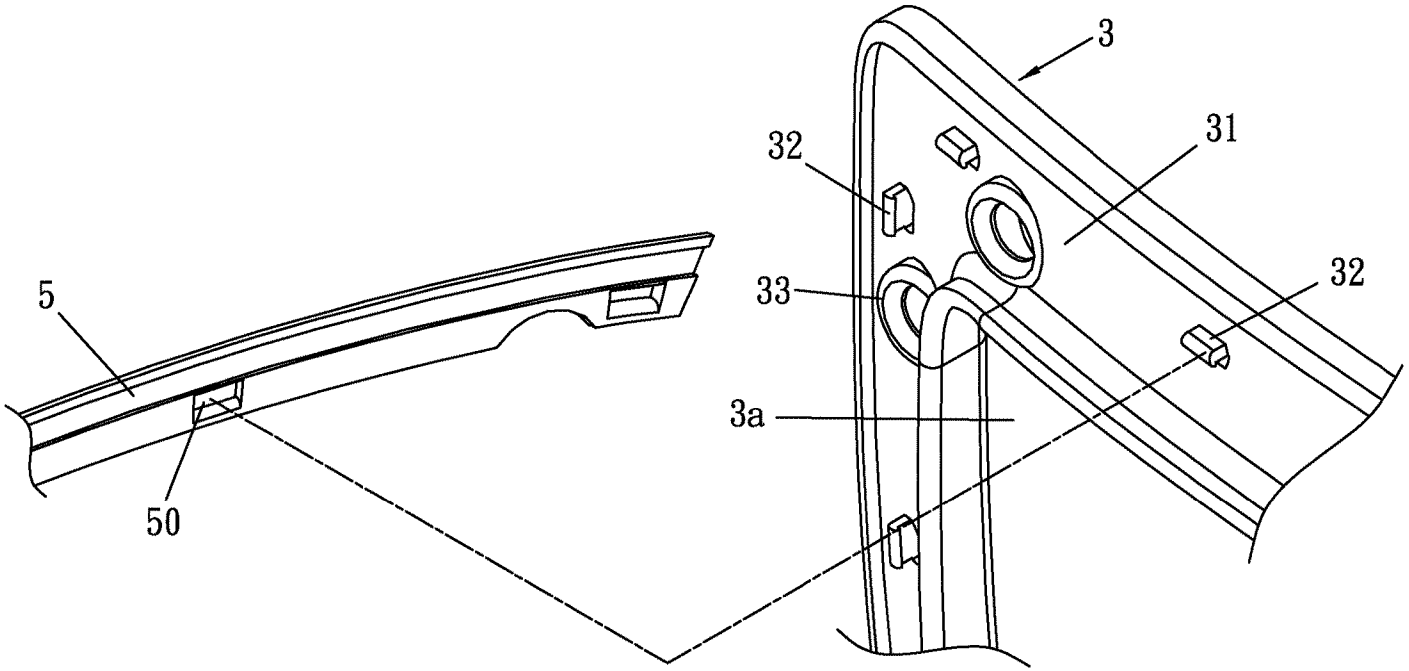
FIG. 3 is a schematic view of the inner frame and pressing strips of the invention.
Figure 6:
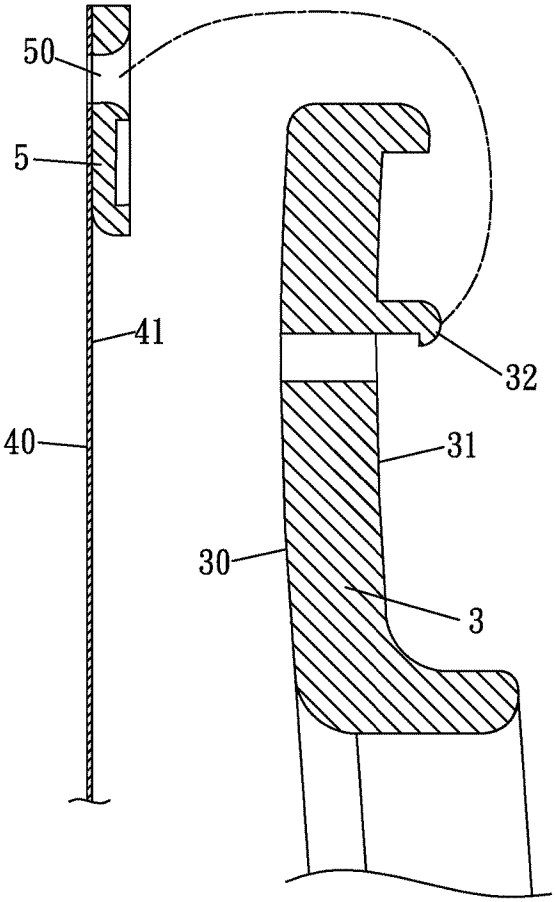
FIG. 6 is a cross-sectional view of the invention, which shows the pressing strip and the supporting body before assembling.
Figure 9:
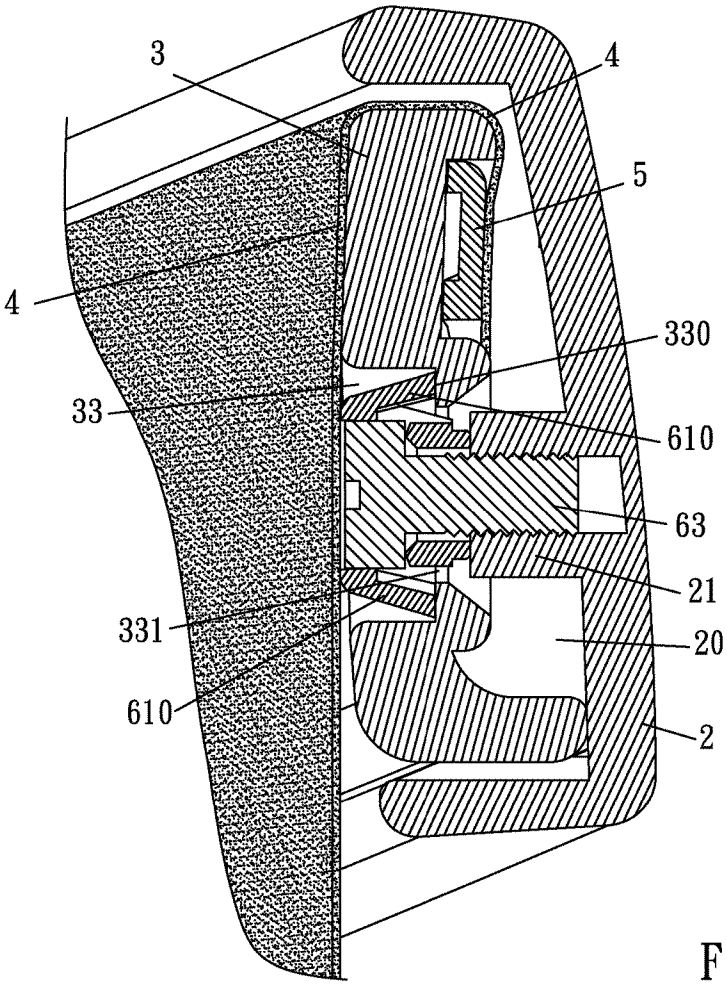
FIG. 9 is a cross-sectional view along line 9-9 in FIG. 8.

Please refer to FIGS. 3, 6 and 9. The inner frame 3 has a front 30 and a rear 31. The rear 31 is formed with hooks 32 corresponding to the fastening holes 50 and installing holes 33. An inner wall of each installing hole 33 is provided with a protrudent step portion 330 and a shrunk hole 331 formed in the step portion 330.

Figure 4:
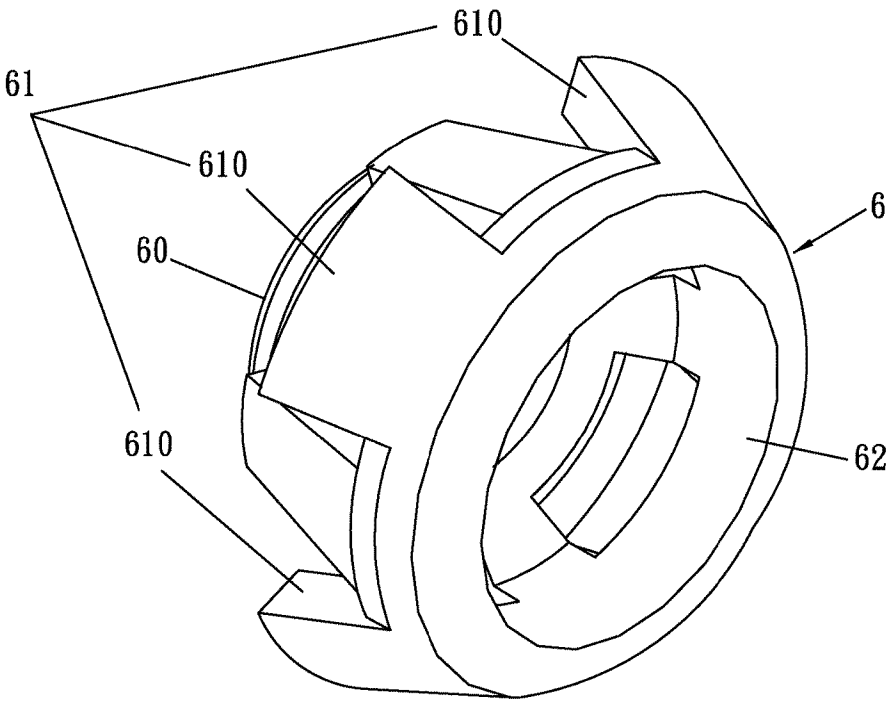
FIG. 4 is a perspective view of the fastener of the invention.
Figure 5:
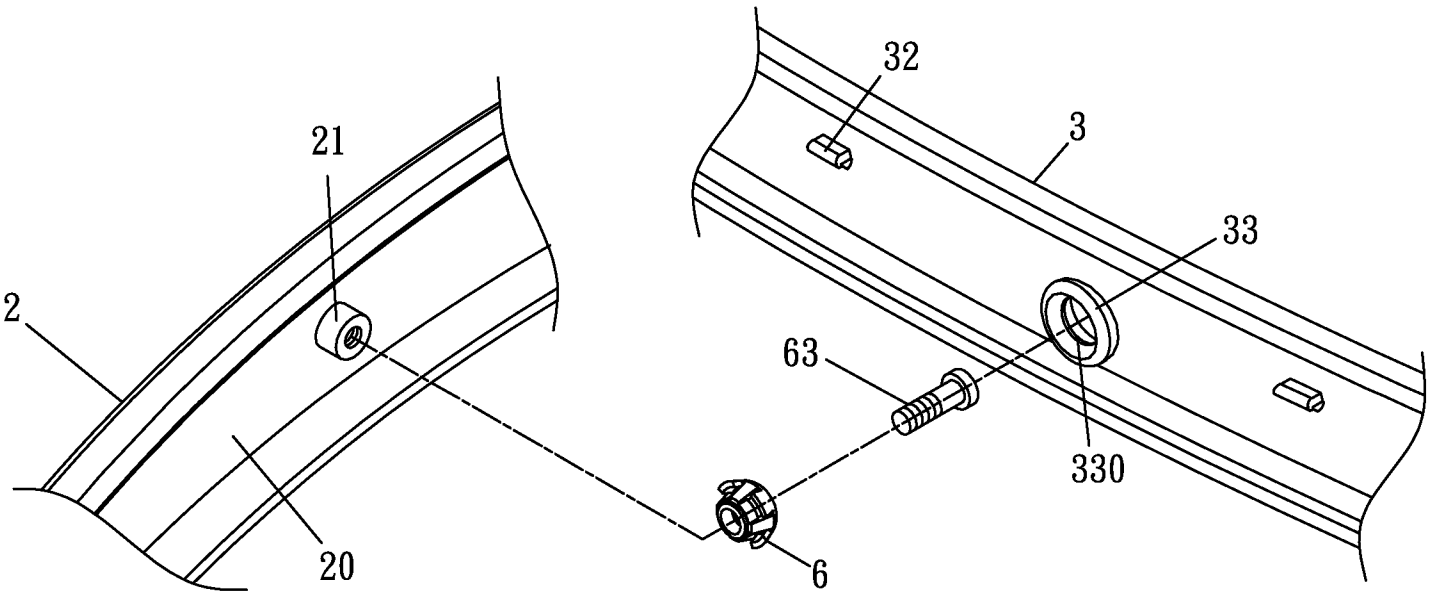
FIG. 5 is a schematic view of the inner frame and the outer frame.

As shown in FIGS. 4 and 5. The fasteners 6 are disposed in the surrounding trough 20. Each fastener 6 corresponds to one of the installing holes 33. The fastener 6 has a connecting end 60 connected to the surrounding trough 20 and an engaging portion 61 engaging with the installing hole 33. Preferably, the engaging portion 61 is composed of elastic arms 610 arranged in an umbrella shape. Please refer to FIG. 9. An outer diameter of the umbrella-shaped engaging portion 61 is greater than an inner diameter of the shrunk hole 331, so that when the engaging portion 61 is passing through the shrunk hole 331, the elastic arms 610 are pressed by the step portion 330, and when the engaging portion 61 has passed the shrunk hole 331, the elastic arms 610 restore to engage with the step portion 330. In addition, the fastener 6 has a through hole 62 through the connecting end 60 so as to be screwed by a bolt 63. The surrounding trough 20 is formed with fixing portions 21 separately corresponding to the fasteners 6. Each fastener 6 can be fixed in the surrounding trough 20 by fastening the bolts 63 into the fixing portions 21.

Figure 7:
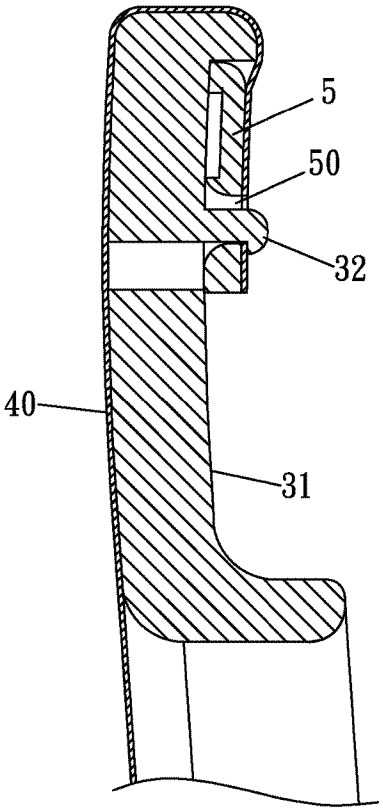
FIG. 7 is a cross-sectional view of the invention, which shows the pressing strip and the supporting body after assembling.

Please refer to FIGS. 6 and 7. When assembling, the connecting side 41 of the supporting body 4 corresponds to the front 30 of the inner frame 3 first, then the regions attached by the pressing strips 5 are folded toward the rear 31 of the inner frame 3 and make the fastening holes 50 separately engage with the hooks 32. As a result, the supporting body 4 is installed onto the inner frame 3.

Figure 8:
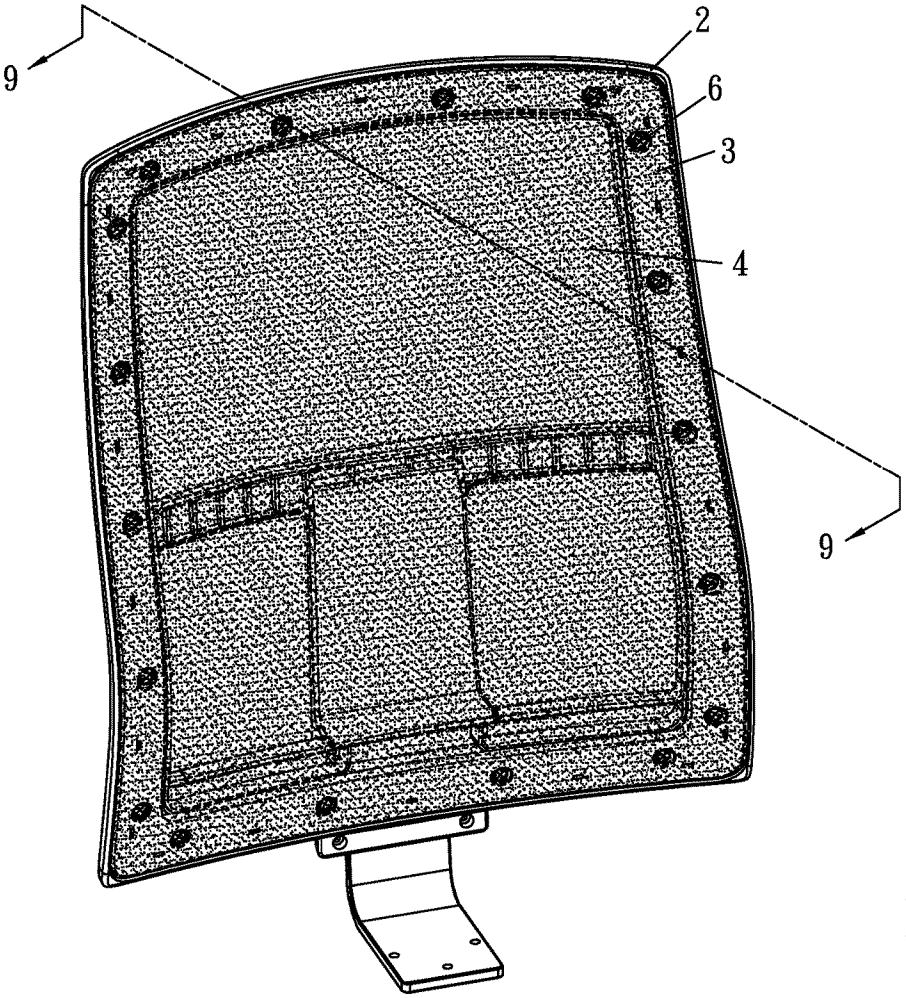
FIG. 8 is an assembled view of the invention.

Please refer to FIGS. 8 and 9. The assembled supporting body 4 and inner frame 3 are embedded into the surrounding trough 20 of the outer frame 2. Meanwhile, each installing hole 33 is engaged with one of the fasteners 6 on the outer frame 2. As abovementioned, when the engaging portion 61 is passing through the shrunk hole 331, the elastic arms 610 are pressed by the step portion 330, and when the engaging portion 61 has passed the shrunk hole 331, the elastic arms 610 restore to engage with the step portion 330. As a result, the assembling is finished.

In comparison with prior art, the invention has following advantages:

1. The pressing strips 5 fix the shape of the soft supporting body 4 in advance. It is advantageous to assembling. And corners of the supporting body 4 can be protected by the pressing strips 4 to prevent crease or damage.

2. The supporting body 4 is assembled on the inner frame 3 in advance. It is advantageous to subsequent management, storage and shift.

3. The fasteners 6 make the connection between the inner frame 3 and outer frame 2 easier. It can be done without tools and can be automatically produced. This can raise production capacity and save labor cost.

4. The inner frame 3 is embedded into the surrounding trough 20 of the outer frame 2, so the supporting body 4 can be fastened by pressure, grip and engagement between the fasteners 6 and the installing holes 33. The supporting body 4 is toughly fixed. The connecting side 41 of the supporting body 4 can be totally cloaked. A better finished appearance can be obtained.

Figure 10:
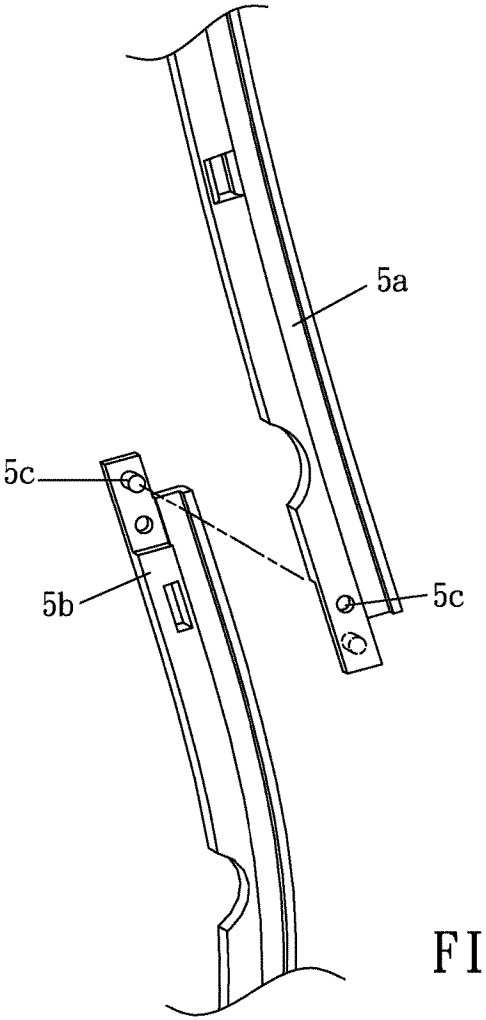
FIG. 10 is a schematic view of another embodiment of the pressing strip of the invention.

Please refer to FIG. 10. Any pressing strip 5 may be formed by connecting two or more pieces, such as a first pressing strip 5*a* and a second pressing strip 5*b*. Each of the first and pressing strips 5*a*, 5*b* is provided with a connecting portion 5*c* to connect each other. As a result, a new pressing strip with different length can be easily obtained.

What is claimed is:

1. A support device of a chair, comprising:

an outer frame, having a surrounding trough;

fasteners, disposed in the surrounding trough, and each having an engaging portion;

an inner frame, having a front and a rear;

a supporting body, made of a flexible material, and having a loading side and a connecting side; and pressing strips, surroundingly attached on a periphery of the connecting side, and an interval being kept between two adjacent pressing strips to provide flexibility;

wherein the supporting body covers the front of the inner frame, the pressing strips are fastened onto the rear of the inner frame, the inner frame with the supporting body is embedded into the surrounding trough to engage with the engaging portions of the fasteners, the inner frame is formed with installing holes corresponding to the engaging portions of the fasteners, an inner wall of each installing hole is provided with a protrudent step portion and a inserting hole formed in the step portion, the engaging portion is composed of elastic arms arranged in an umbrella shape, an outer diameter of the engaging portion is greater than an inner diameter of the inserting hole, so that when the engaging portion has passed the inserting hole, and the elastic arms restore to engage with the step portion.

2. The assembling structure of claim 1, wherein each pressing strip is formed with fastening holes, the rear of the inner frame is formed with hooks corresponding to the fastening holes, and each of the hooks engages with one of the fastening holes to fasten the pressing strip.

3. The assembling structure of claim 1, wherein each fastener has a connecting end connected to the surrounding trough and a through hole through the connecting end, the through hole is screwed by a bolt, the surrounding trough is formed with fixing portions corresponding to the fasteners, and each fastener is fixed in the surrounding trough by fastening the bolts into the fixing portions.

4. The assembling structure of claim 1, wherein one of the pressing strips is formed by connecting a first pressing strip and a second pressing strip, and each of the first and second pressing strips is provided with a connecting portion to connect the first and second pressing strips.

5. A support device of a chair, comprising:

an outer frame, having a surrounding trough;

an inner frame, embedded into the surrounding trough, having a front and a rear, being formed with installing holes, and an inner wall of each installing hole being provided with a protrudent step portion and an inserting hole formed in the step portion;

a supporting body, made of a flexible material, and having a loading side and a connecting side, covering the front of the inner frame, and fastened on the rear of the inner frame; and fasteners, disposed in the surrounding trough, and each having an engaging portion, the engaging portion being composed of elastic arms arranged in an umbrella shape, an outer diameter of the engaging portion being greater than an inner diameter of the inserting hole, wherein when the engaging portion has passed the inserting hole, the elastic arms restore to engage with the step portion.

6. The assembling structure of claim 5, further comprising pressing strips surroundingly attached on a periphery of the connecting side of the connecting body, and an interval being kept between two adjacent pressing strips to fasten the supporting body to the rear of the inner frame.

7. The assembling structure of claim 6, wherein each pressing strip is formed with fastening holes, the rear of the inner frame is formed with hooks corresponding to the fastening holes, and each of the hooks engages with one of the fastening holes to fasten the pressing strip.

8. The assembling structure of claim 5, wherein each fastener has a connecting end connected to the surrounding trough and a through hole through the connecting end, the through hole is screwed by a bolt, the surrounding trough is formed with fixing portions corresponding to the fasteners, and each fastener is fixed in the surrounding trough by fastening the bolts into the fixing portions.

* * * * *